United States Patent [19]

Barnes

[11] 4,398,626

[45] Aug. 16, 1983

[54] LOW FREQUENCY PHASE SHIFT COIN EXAMINATION METHOD AND APPARATUS

[75] Inventor: Elwood E. Barnes, Parkesburg, Pa.

[73] Assignee: Mars, Inc., McLean, Va.

[21] Appl. No.: 295,138

[22] Filed: Aug. 21, 1981

[51] Int. Cl.[3] ..... G07F 3/02

[52] U.S. Cl. ..... 194/100 A; 194/100 R; 73/163

[58] Field of Search ..... 194/100 A, 100 R, 1 K; 133/3 R; 73/163; 307/262; 324/233; 328/5

[56] References Cited

U.S. PATENT DOCUMENTS

| | | | |
|---|---|---|---|
| 3,059,749 | 10/1962 | Zinke | 194/100 R |
| 3,599,771 | 8/1971 | Hinterstocker | 194/100 A |
| 3,741,363 | 6/1973 | Hinterstocker | 194/100 A |
| 3,870,137 | 3/1974 | Fougere | 194/100 A |
| 3,907,086 | 9/1975 | Willis | 194/1 K |
| 3,966,034 | 6/1976 | Heiman et al. | 194/100 A |
| 3,995,235 | 11/1976 | Kaplan | 307/262 X |
| 4,086,527 | 4/1978 | Cadot | 324/233 |
| 4,349,095 | 9/1982 | Lewis | 194/100 A |

OTHER PUBLICATIONS

Wellsby, V. G., The Theory and Design of Inductance Coils, McDonald, London, 1960, p. 132.

*Primary Examiner*—Joseph J. Rolla
*Assistant Examiner*—Jan Konlarek
*Attorney, Agent, or Firm*—Davis, Hoxie, Faithfull & Hapgood

[57] ABSTRACT

A method and apparatus for coin examination which subjects one side of a coin to a low frequency electromagnetic field from a transmitter inductor driven by an astable oscillator and frequency divider, receives a portion of the field on the other side of the coin with a receiving inductor, amplifies the output of the receiving inductor with a non-linear amplifier, and measures the phase shift between the signal driving the transmitter inductor and the amplifier output.

16 Claims, 5 Drawing Figures

LOW FREQUENCY PHASE SHIFT COIN EXAMINATION METHOD AND APPARATUS

FIELD OF INVENTION

The present invention relates to examination of coins for authenticity and denomination, and more particularly to the examination of coin material characteristics through the use of a low frequency electromagnetic field.

BACKGROUND OF THE INVENTION

It has long been recognized in the coin examining art that the interaction of an object with a low frequency electromagnetic field can be used to indicate, at least in part, the material composition of the object and thus whether or not the object is an acceptable coin and its denomination. See, for example, U.S. Pat. No. 3,059,749. It has also been recognized that such low frequency tests are advantageously combined with one or more tests at a higher frequency. See, for example, U.S. Pat. No. 3,870,137. The optimum methods for low frequency testing have, in the past, used bridge circuits which incorporate testing of both phase and amplitude effects of coin interaction with an electromagnetic field.

Another technique which has been popular in the testing of coins has been the transmit-receive technique in which an electromagnetic field is created by an inductor adjacent one face of a coin and characteristics of the received signal adjacent the other face are examined to determine the coin's authenticity and denomination.

U.S. Pat. Nos. 3,599,771 and 3,741,363, for example, each discloses a transmitter coil creating an electronic field at either end. Spaced adjacent each end of the transmitter coil is a secondary coil. The two secondary coils are electrically connected in series, and have opposing orientations with respect to the transmitting coil field. An unknown coin is placed between one secondary coil and the transmitting coil and a known coin is placed between the other secondary coil and the transmitting coil. The unknown coin is accepted only if the signal delivered by the secondary coils does not exceed a threshhold value. Such an arrangement, of course, is suitable only for examination of one coin denomination per testing station.

U.S. Pat. No. 3,966,034, assigned to the assignee of the present application, discloses a phase sensitive coin discrimination method and apparatus operating by the transmit-receive technique with particular utility in distinguishing between two similar coins such as the British 5P and the West German 1DM. Unlike the present invention, the detailed embodiments of that patent operate at relatively high frequencies (e.g. 320 kHz) and rely upon differences in coin volume to help distinguish between otherwise similar coins.

U.S. Pat. No. 4,086,527, discloses a transmit-receive type coin examining apparatus in which the transmitter coil is driven by a controlled variable frequency oscillator operated at one or more selected frequencies in the range of 5–300 kHz. The secondary or receiving coil is connected to an undisclosed "quantifying operator" circuit which obtains quantitative information regarding amplitude of the secondary signal and its phase with respect to the primary (transmitted) signal.

SUMMARY OF THE INVENTION

The present invention relates to a method and apparatus for examining the interaction of coins with a relatively low frequency electromagnetic field at which the coin material plays a significant role. The transmit-receive technique is used and the phase shift that results from the presence of a coin or other object between the transmitting inductor, which creates the field, and the receiving inductor is used as an indication of the identity of the coin. In order to enhance the ability of the method and apparatus to distinguish between coins, a non-linear amplifier is employed between the receiving inductor and the phase shift measuring means. The amplifier introduces an additional phase shift which is inversely related to the amplitude of the output of the receiving inductor.

Other features and advantages of the invention will be clear from the drawings and the detailed description of an embodiment of the invention which follows.

Although coin selector apparatus constructed in accordance with the principles of this invention may be designed to identify and accept any number of coins from the coin sets of many countries, the invention will be adequately illustrated by explanation of its application to identifying the U.S. 5-, 10-, and 25-cent coins. The figures are intended to be representational and are not necessarily drawn to scale. Throughout this specification the term "coin" is intended to include genuine coins, tokens, counterfeit coins, slugs, washers, and any other item which may be used by persons in an attempt to use coin-operated devices. Furthermore, from time to time in this specification, for simplicity, coin movement is described as rotational motion; however, except where otherwise indicated, translational and other types of motion also are contemplated. Similarly, although specific types of logic circuits are disclosed in connection with the embodiments described below in detail, other logic circuits can be employed to obtain equivalent results without departing from the invention.

DETAILED DESCRIPTION

Figure 1:
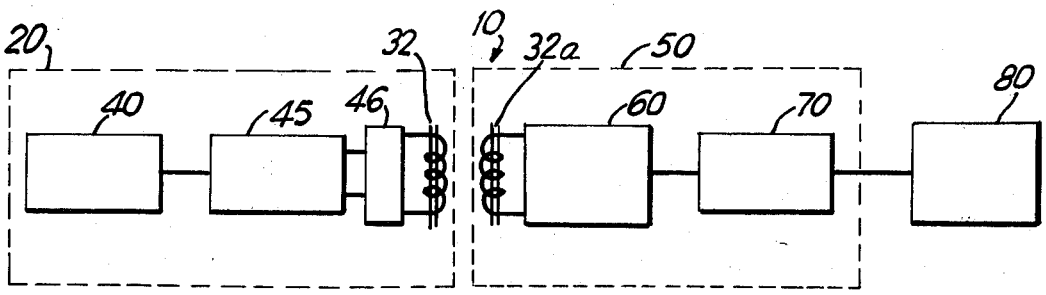
FIG. 1 is a schematic block diagram of an embodiment of the coin examining circuit in accordance with the invention.

FIG. 1 shows a block schematic diagram of a coin examining circuit 10 in accordance with the present invention. The coin examining circuit 10 includes two principal sections: the transmitter 20 and the receiver 50. In this embodiment, the major components of the transmitter 20 are a transmitter inductor 32, an oscillator circuit 40, a frequency divider circuit 45 and a driver circuit 46. The major components of the receiver 50 are the receiver inductor 32*a*, the amplifier 60 and the gating circuit 70. The output of the receiver 50 is delivered to a counting and processing circuit 80, the details of which are not a part of the present invention.

Figure 2:
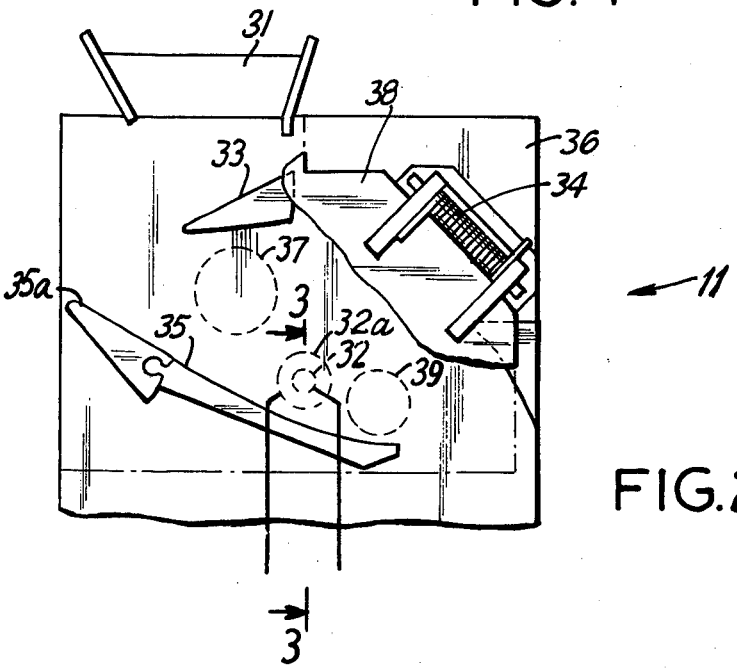
FIG. 2 is a schematic diagram indicating locations of the inductors suitable for the embodiment of FIG. 1.
Figure 3:
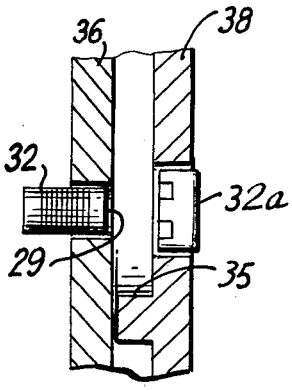
FIG. 3 is a cross-sectional view of a coin passageway along line 3—3 of FIG. 2 showing the locations of transmitting and receiving inductors suitable for the embodiment of FIG. 1.

FIGS. 2 and 3 show the mechanical portion of a coin handling apparatus 11 suitable for this embodiment including the location of transmitter and receiver inductors 32 and 32*a*. (A relatively higher frequency inductive coin examining circuit, such as that disclosed in the co-pending application entitled "Coin Examination Apparatus Employing an RL Relaxation Oscillator", Ser. No. 295,931, filed Aug. 21, 1982, and assigned to the assignee of this application, can be advantageously incorporated in the same apparatus for more complete testing of coin characteristics. The locations of inductors as disclosed in an embodiment of that application are indicated by the broken lines 37 and 39 in FIG. 2 of the present application.)

The coin handling apparatus 11 also includes a conventional coin receiving cup 31, two spaced sidewalls 36 and 38, connected by a hinge and spring assembly 34 in a manner similar to that shown in U.S. Pat. No. 3,907,086, except that the retarding apparatus disclosed in that patent is not necessarily used. The sidewalls 36, 38 are tipped slightly from the vertical so that the coins bear facially on the sidewall in which the receiver inductor 32*a* is located, here the front sidewall 38. The portions of the apparatus 11 shown in FIGS. 2 and 3 also include a first coin track 33 under the coin entry cup 31 comprising an edge of a first energy dissipating device, and a second coin track 35 comprising an edge of a second energy dissipating device 35*a*, which forms the initial track section, and a terminal track section which is molded from plastic along with the sidewall 36. The energy dissipating devices 33, 35*a*, track 35 and sidewalls 36, 38 form a coin passageway from the coin entry cup 31 past the coin testing inductors 32, 32*a*. Coins entering the apparatus 11 fall edgewise onto a first energy dissipating element 33, roll off and fall onto a second energy dissipating element 35*a* which forms the initial section of a coin track 35 on which the coin rolls past the transmitter inductor 32 and the receiver inductor 32*a*.

Figure 4:
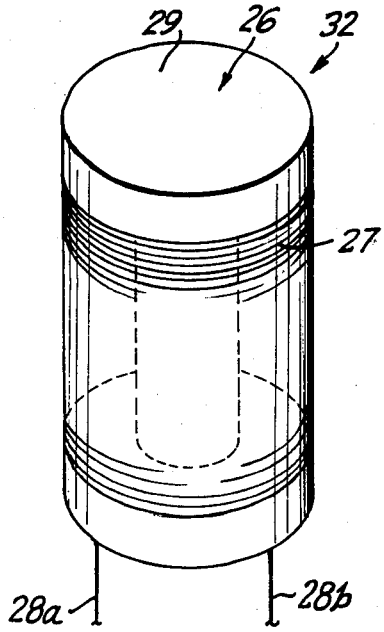
FIG. 4 is a transmitting inductor suitable for the embodiment of FIG. 1.

The transmitter inductor 32, shown in FIG. 4, is of a type designed to produce a projecting magnetic field from its ends. The core 26 of the transmitter inductor 32 is dumbbell shaped, in this case, having two relatively large diameter cylindrical end pieces connected by a smaller diameter central section. The coil 27 is wound about the central section of the core 26 and the ends of the coil 27 are connected to leads 28*a* and *b*.

As shown in FIGS. 2 and 3, the transmitter inductor 32 is located in a recess in the plastic back sidewall 36 of the coin apparatus with one end 29 adjacent a coin passageway formed by sidewalls 36 and 38. In a recess in the opposite, front sidewall 38 is the receiver inductor 32*a*. It is of the conventional pot core type. The axes of the two inductors 32 and 32*a* coincide in this embodiment, although they need not do so in all embodiments of the invention.

In this embodiment, which is designed primarily for identification of United States coinage, the nearest faces of the inductors 32 and 32*a* are about 3.8 mm apart. The axes of the inductors 32 and 32*a* are located 9.77 mm above the track 35 on which coins roll as they pass through the coin testing section of the apparatus. The transmitter inductor 32 is 10 mm long by 8 mm in diameter with a central section 3.6 mm long, and has an inductance of 10 mH. The receiver inductor 32*a* is approximately 7 mm deep by 13.63 mm in diameter and has an inductance of 52 mH.

Figure 5:
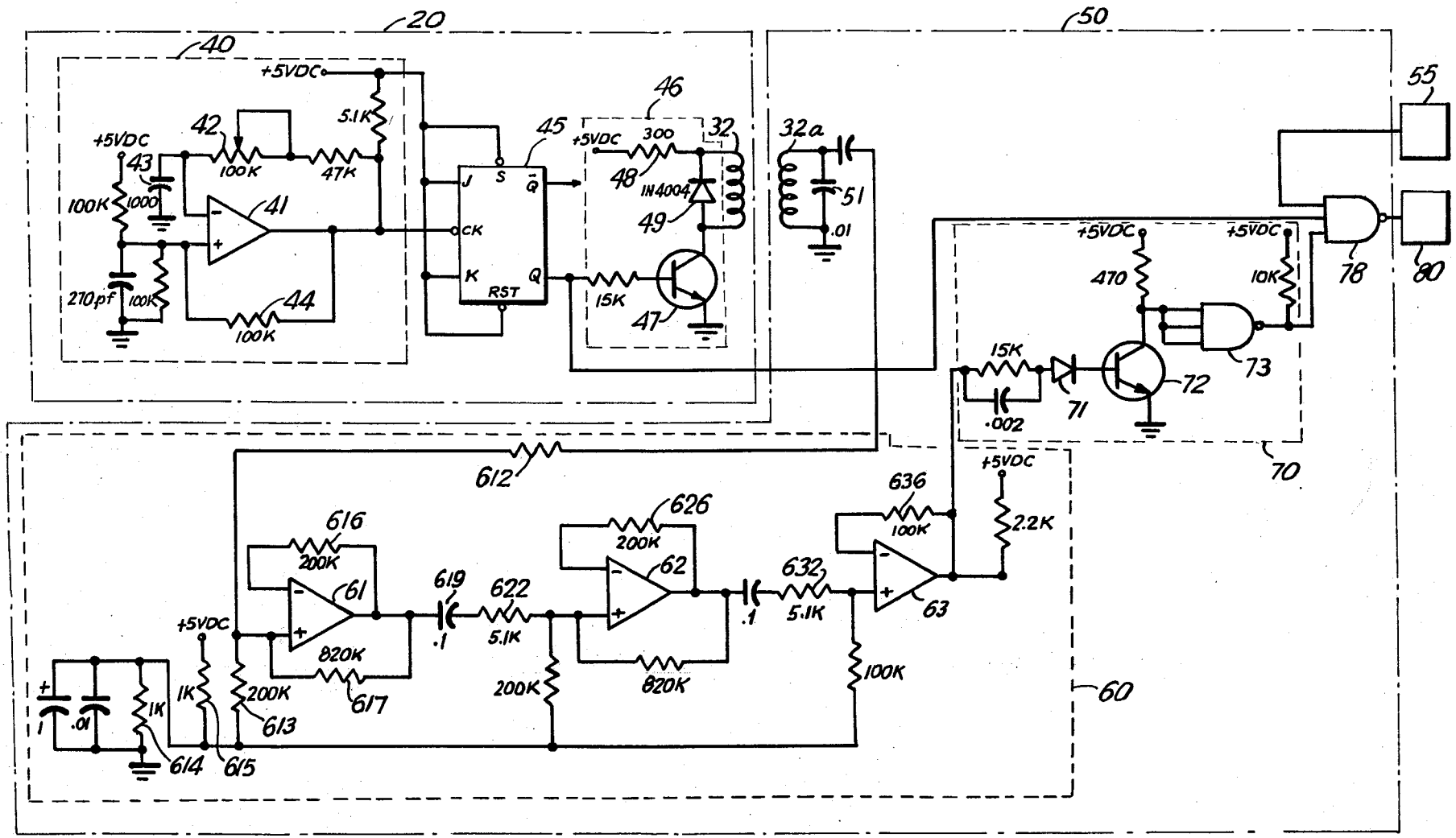
FIG. 5 is a detailed schematic diagram of a circuit suitable for the embodiment of FIG. 1.

FIG. 5 is a detailed schematic diagram of a circuit in accordance with one embodiment of the present invention. The oscillator 40 within the transmitter 20 is an astable RC oscillator circuit producing a square wave with a frequency of approximately 12 kHz. This signal is reasonably independent of voltage and temperature. The frequency of oscillation can be varied by adjustment of the feedback resistor 42. The amplifier 41 in the oscillator 40 is one section of a National Semiconductor type LM339 open collector comparator. Its positive input is biased at either $\frac{1}{3}$ or $\frac{2}{3}$ of the supply voltage (+5 VDC here), depending on its output state. The charging and discharging of capacitor 43 at the inverting (−) input terminal of the amplifier 41, together with the hysterisis resistor 44 from the output of the amplifier 41 to its non-inverting input (+) provides the oscillating operation. Thus the oscillator 40 provides a stable 12 kHz square wave of approximately 50% duty cycle to the divider circuit 45. The frequency divider circuit 45 comprises a conventional JK flip-flop (such as a National Semiconductor type 74LS76) connected as a toggle flip-flop. As a result, it provides a 50% duty cycle signal at each of its Q and Q outputs at half of the oscillator frequency, approximately 6 kHz in this example.

The Q output of the divider flip-flop 45 is connected to the driver circuit 46. The flip-flop 45 output drives the base of the transmitter drive transistor 47. The current through the transmitter inductor 32 is limited by the resistor 48 (300 ohms here) in series with the inductor 32. The current through the transmitter inductor 32 will obey this equation when the drive transistor 47 is turned on:

$$i_L = V_{CC}(1 - e^{-R_L t/L})$$

where $R_L$ is the series resistance of resistor 48 and the resistance of the inductor coil. With circuit values used, $R_L = 300$ and $L = 100$ mH, the equation becomes $$i_L = 16.7(1 - e^{-3\times 10^4 t}).$$

When transistor Q1 has just turned off, i.e., when t = time per cycle × fraction of cycle during which transistor 47 is on $= (1/6\ \text{KHz}) \times \frac{1}{2} = 84 \times 10^{-6}$, then $i_L = 16.7(1 - 0.08)$ or $i_L = 16.7(0.92) = 15.6$ mA.

Thus, the current has increased almost to its maximum possible value when the drive is removed from transistor 47, i.e., when the square wave from flip-flop 45 is low. When transistor 47 turns off, the diode 49 across the inductor 32 becomes forward biased and the current through the inductor 32 damps down toward zero. Thus, the driver circuit 46 produces a nearly triangular wave of current through the transmitter inductor 32, producing an electromagnetic field in the coin passageway.

The input to the receiver 50 is provided by the coupling of the transmitter inductor 32 to the receiver inductor 32*a*. In this embodiment, the receiver 50 is tuned to approximately 7 kHz by the 0.01 uF±5% capacitor 51 across the receiver inductor 32*a*. The amplitude of the AC signal across the receiver inductor 32*a* is normally in the range of 50 to 500 mV (peak to peak) with a coin present between the inductors 32 and 32*a*.

The center frequency of the passband of the tuned circuit formed by the receiver inductor 32*a* and the capacitor 51 across it is intentionally close to but offset from the nominal frequency of the flip-flop 45. In this case, the receiver 50 is tuned to a higher frequency. As a result of this offset, and the frequency-amplitude response characteristic of this tuned circuit, variation of oscillator frequency by use of adjustable resistor 42 will produce a variation in the amplitude of the signal at the output of the receiver inductor 32*a*.

The receiver section 50 in this embodiment is based upon a three stage AC coupled amplifier 60. The amplifiers 61, 62 & 63, are National Semiconductor LM3900 Norton type current amplifiers used in a non-inverting mode of operation.

The first amplification stage of amplifier 60 has a gain of approximately 13.3, determined by dividing the value of the series input resistor 612 (15K) into the negative feedback resistance 616 (200K) between the output of the amplifier 61 and its inverting (−) input. A bias network consisting of resistors 614 & 615 (each 1K) produces +2.5 VDC for operation of the amplifiers. To place the base line of the output of the amplifier 61 at the mid-point between the 0 and 5.0 VDC power supply rails, the value of the resistor 613 from the midpoint of the bias network 614, 615 to the non-inverting input of the amplifier 61 equals the value of the feedback resistor 616. In addition, a hysteresis resistor 617 is provided between the output of the amplifier 61 and the non-inverting (+) input. The hysteresis resistor 617 provides sufficient positive feedback to prevent triggering by noise and transients, and to reduce adverse effects of coupling between stages through their common current source when the signal level is low, for example, due to the presence of a coin which absorbs or blocks a very high percentage of the field from the transmitter inductor 32.

The output of the first stage is AC coupled to the second stage by a capacitor 619. The second stage, including amplifier 62, is quite similar to the first stage except that its gain, determined by input resistor 622 and feedback resistor 626, is approximately 39.1.

The third and final stage of amplification is similar to the other stages except that it lacks a hysteresis resistor. Its gain, determined by the input and feedback resistors 632 & 636 is approximately 19.6. The feedback resistor 636 in this embodiment is smaller than that of the other stages, 100K instead of 200K, and the size of the bias resistor 633 is correspondingly reduced. Since the composite gain of the three stages is approximately 10,000, the last stage output has characteristics nearly those of a comparator, because its output quickly swings nearly from power supply rail to rail.

The output of the amplifier 60 is a square wave, the pulse width and phase (with respect to the output of the divider circuit 45) of which vary with the presence and type of coin affecting inductors 32 and 32*a*. The phase shift at the output of amplifier 60 is primarily due to the change introduced in the electromagnetic field as it passes through and around the coin being examined. The amplifier 60 according to this invention introduces an additional phase shift which is inversely related to the amplitude of the output of the receiver inductor 32*a*. This non-linear response is provided in this embodiment by the Norton type current amplifiers 61, 62 and 63. The reason for introducing this additional phase shift is two-fold. First, I have found it desirable to distinguish between two different coins which absorb different amounts of energy from the electromagnetic field, thereby producing different signal amplitudes at the output of the receiver inductor 32*a*, but which would otherwise produce substantially the same phase shift. Two such coins are the U.S. 25-cent and British 2P coins. By introducing an amplitude dependent additional phase shift at the output of the amplifier 60, these coins can be readily distinguished. Second, the additional phase shift makes the width of the output pulse from the amplifier 60 dependent upon the frequency of oscillation of the oscillator circuit 20, due to the offset of that frequency from the center of the receiver 50 passband and the frequency-amplitude response of the receiver 50.

The output of the amplifier 60 is converted from an analog square wave, which may have a poorly defined shape at the lower levels, to a well defined square wave for digital circuitry by the gating circuit 70. The diode 71 causes the lower level portion of the output of amplifier 60 to be ignored by the gating circuit 70. Transistor 72, a type 2N3563 in this embodiment, produces a well defined square wave signal. The NAND gate 73, a section of a National Semiconductor type 74LS10 NAND gate, is used to invert the output of the transistor 72 to maintain the same source sense as the output of the amplifier 60.

The signal from NAND gate 73 is applied to an input of the NAND gate 78 as is the signal from the Q output of the transmitter section flip-flop 45, and 2 MHz repetition rate pulses from clock 55, which may be a part of a system controlling microprocessor. As a result, the output of the NAND gate 78 is a series of pulses, the number of which is a composite, representative of both the phase shift between the transmitted and received signals, and the amplitude of the received signal. With the foregoing circuit, the numerical peak pulse count at the output of the NAND gate 78 under various conditions is as follows:

| Conditions | Nominal Count |
|---|---|
| No Coin | 0 |
| U.S. 5 cents | 16–20 |
| U.S. 10 cents | 83 |
| U.S. 25 cents | 85 |
| U.S. $1. (Anthony) | 85 |
| U.K. 2p (representative of copper slugs) | 90–92 |

The counter and conversion circuit 80, which can be a hard-wired circuit or a microprocessor, counts the pulses from the NAND gate 78 and produces an indication of the identity of the coin based on the peak pulse count and previously stored information. By varying the frequency of the oscillator circuit 30 in the manner previously described, the count produced by a particular apparatus (which may vary from the norm due to component variations) can be adjusted to correspond to a stored acceptable count. For example, the frequency is adjusted for a U.S. 25-cent coin so that the count is 85. This adjustment will also vary the counts for other coins sufficiently that all are brought into range by this single, simple adjustment.

I claim:

1. A method for examining coins comprising the steps of generating a low frequency electrical signal, subjecting a coin to an electromagnetic field produced by a first inductor driven by the low frequency signal, receiving a portion of the field with a second inductor when the coin is between the first and second inductors, amplifying the electrical output of the second inductor which is produced by the field, and measuring the phase shift between the low frequency signal which drives the first inductor and the amplified output of the second inductor, wherein an additional phase shift inversely related to the amplitude of the output of the second inductor is introduced in the amplifying step.

2. The method of claim 1 wherein the frequency of the low frequency signal is in the range of 1 to 50 kHz.

3. The method of claim 1 wherein the frequency of the low frequency signal is approximately 6 kHz.

4. The method of claim 1 wherein the second inductor is a part of a tuned circuit having the center of its passband offset from the frequency of the low frequency signal.

5. Apparatus for examining coins comprising means defining a coin passageway, means for producing a low frequency electrical signal, a first inductor connected to the output of the signal producing means, the first inductor being located on one side of the coin passageway and arranged to produce an electromagnetic field in the coin passageway, a second inductor located on the other side of the coin passageway from the first inductor at a place where coins to be examined will pass between the first and second inductors, the second inductor being arranged to receive a portion of the field in the passageway, an amplifier connected to receive the output of the second inductor, and means for measuring the phase shift between the low frequency signal and the output of the amplifier, wherein the amplifier introduces an additional phase shift which is inversely related to the amplitude of the output of the second inductor.

6. The apparatus of claim 5 wherein the frequency of the low frequency signal is in the range of 1 to 200 kHz.

7. The apparatus of claim 5 wherein the frequency of the low frequency signal is approximately 6 kHz.

8. The apparatus of claim 5 wherein the means for producing a low frequency signal comprises an astable oscillator.

9. The apparatus of claim 8 wherein the means for producing a low frequency signal further comprises a frequency divider having an output duty cycle of approximately 50%.

10. The apparatus of claim 5 wherein the first inductor has a dumbbell-shaped core and one end of the dumbbell faces the second inductor.

11. The apparatus of claim 10 wherein the second inductor has a pot core.

12. The apparatus of any of claims 5 through 11 wherein the inductor is part of a tuned circuit having the center of its passband offset from the frequency of the low frequency signal.

13. The apparatus of any of claims 5 through 11 wherein the amplifier comprises two or more AC coupled stages of amplification and at least one of the stages is of the Norton type.

14. The apparatus of any of claims 5 through 11 further comprising a signal squaring circuit between the output of the amplifier and the phase shift measuring means.

15. The apparatus of any of claims 5 through 11 further comprising a source of high frequency clock pulses wherein the phase shift measuring means comprises a counter means and gate circuit means having inputs connected to receive signals from the means for producing a low frequency signal, the output of the amplifier and the source of high frequency clock pulses, and the output of the gate circuit means is connected to the counter means.

16. The apparatus of any of claims 5 through 11 wherein the means for producing a low frequency electrical signal further comprises an adjustable resistor for varying the frequency of the low frequency electrical signal.

* * * * *

UNITED STATES PATENT AND TRADEMARK OFFICE

CERTIFICATE OF CORRECTION

PATENT NO. : 4,398,626

DATED : August 16, 1983

INVENTOR(S) : Elwood E. Barnes

It is certified that error appears in the above-identified patent and that said Letters Patent are hereby corrected as shown below:

Col. 4, line 20, "Q" (second occurrence) should be --$\bar{Q}$--.

Col. 4, line 36, "100 mH" should be --10 mH--.

Signed and Sealed this

*Eighteenth* Day of *October 1983*

[SEAL]

*Attest:*

GERALD J. MOSSINGHOFF

*Attesting Officer*

*Commissioner of Patents and Trademarks*